US010113222B2

(12) United States Patent
Engler et al.

(10) Patent No.: US 10,113,222 B2
(45) Date of Patent: Oct. 30, 2018

(54) ALUMINIUM ALLOY WHICH IS RESISTANT TO INTERCRYSTALLINE CORROSION

(71) Applicants: Olaf Engler, Bonn (DE); Henk-Jan Brinkman, Bonn (DE); Thomas Hentschel, Bonn (DE); Eike Brünger, Denzlingen (DE)

(72) Inventors: Olaf Engler, Bonn (DE); Henk-Jan Brinkman, Bonn (DE); Thomas Hentschel, Bonn (DE); Eike Brünger, Denzlingen (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 25 days.

(21) Appl. No.: 14/617,469

(22) Filed: Feb. 9, 2015

(65) Prior Publication Data

US 2015/0152537 A1 Jun. 4, 2015
US 2017/0152589 A9 Jun. 1, 2017

Related U.S. Application Data

(63) Continuation of application No. PCT/EP2013/067481, filed on Aug. 22, 2013.

(30) Foreign Application Priority Data

Aug. 28, 2012 (EP) ..... 12182038

(51) Int. Cl.

| | |
|---|---|
| ***C22F 1/047*** | (2006.01) |
| ***C22C 21/06*** | (2006.01) |
| ***C22C 21/08*** | (2006.01) |
| *C22F 1/04* | (2006.01) |
| *C22C 21/00* | (2006.01) |

(52) U.S. Cl.
CPC ..... *C22F 1/047* (2013.01); *C22C 21/08* (2013.01)

(58) Field of Classification Search
CPC ..... C22C 21/06; C22C 21/08; C22F 1/047
See application file for complete search history.

(56) References Cited

U.S. PATENT DOCUMENTS

| | | | | |
|---|---|---|---|---|
| 2003/0145912 | A1* | 8/2003 | Haszler | C22C 21/06 148/417 |
| 2004/0261922 | A1 | 12/2004 | Van Der Hoeven et al. | |
| 2007/0187009 | A1 | 8/2007 | Van Der Hoeven et al. | |

FOREIGN PATENT DOCUMENTS

| | | | |
|---|---|---|---|
| CA | 2 882 691 | A1 | 2/2014 |
| CN | 101437678 | A | 5/2009 |
| CN | 101880803 | A | 11/2010 |
| DE | 102 31 437 | A1 | 2/2003 |
| EP | 1 078 109 | B1 | 1/2003 |
| JP | 55008499 | A | 1/1980 |
| JP | 04063255 | A | 2/1992 |
| JP | 2000273593 | A | 10/2000 |
| JP | 2001064744 | A | 3/2001 |
| JP | 2002543289 | A | 12/2002 |
| WO | WO 99/42627 | A1 | 8/1999 |

OTHER PUBLICATIONS

"International Alloy Designations and Chemical Composition Limits for Wrought Aluminum and Wrought Aluminum Alloys", Feb. 2009, The aluminum Association, Arlington, VA.*

* cited by examiner

*Primary Examiner* — Lois L Zheng
(74) *Attorney, Agent, or Firm* — Reinhart Boerner Van Deuren P.C.

(57) ABSTRACT

The invention relates to an aluminium alloy, the use of an aluminium alloy strip or sheet and a method for producing an aluminium alloy strip or sheet. An aluminium alloy which has only a slight tendency towards intercrystalline corrosion and which at the same time provides high levels of strength and good deformability and which contains standard alloy components so that the recycling of the aluminium alloy is simplified is provided herein.

12 Claims, No Drawings

ALUMINIUM ALLOY WHICH IS RESISTANT TO INTERCRYSTALLINE CORROSION

CROSS-REFERENCE TO RELATED PATENT APPLICATIONS

This patent application is a continuation of PCT/EP2013/067481, filed Aug. 22, 2013, which claims priority to European Application No. 12 182 038.5, filed Aug. 28, 2012, the entire teachings and disclosure of which are incorporated herein by reference thereto.

FIELD OF THE INVENTION

The invention relates to an aluminium alloy, the use of an aluminium alloy strip or sheet and a method for producing an aluminium alloy strip or sheet.

BACKGROUND OF THE INVENTION

Aluminium/magnesium (AlMg) alloys of the type 5xxx are used in the form of sheets or plates or strips for the construction of welded or joined structures, in ship, automotive and aircraft construction. They are distinguished by a particularly high level of strength, the levels of strength of the AlMg alloys increasing as the magnesium content increases. Typical representatives of aluminium alloys of the type 5xxx are, for example, the aluminium alloys of the type AA 5049, AA 5454 or AA 5918. The alloys are AlMg2Mn (5049)—AlMg3Mn (5454)—or AlMg3.5Mn (5918) aluminium alloys. The constant requirement for additional reduction of weight requires aluminium alloys with higher levels of strength and consequently with correspondingly higher magnesium (Mg) contents in order to provide the desired levels of strength. The problem with AlMgMn aluminium alloys with Mg contents of more than 2.4% by weight is that they have an increased tendency towards intercrystalline corrosion when they are subjected to high temperatures for longer periods of time. It has been found that in AlMgMn aluminium alloys with more than 2.4% by weight of magnesium, at temperatures of from 70 to 200° C., $\beta$-$Al_5Mg_3$ phases are precipitated along the grain boundaries. When the grain boundaries are continuously occupied with $\beta$ particles and when a corrosive medium is present, the dissolution of these $\beta$ phases may lead to a selective corrosion attack along the grain boundaries. Consequently, this leads to aluminium alloys with increased Mg contents either not being able to be used in thermally loaded regions or having to have reduced Mg contents as a result of the heat development so that the precipitation of $\beta$-$Al_5Mg_3$ particles is minimised and a continuous occupation of the grain boundaries with $\beta$-$Al_5Mg_3$ particles is excluded. Proposals for a solution to this problem have already been set out in the prior art. For example, the German Patent Application DE 102 31 437 A1 proposes significantly reducing the susceptibility with respect to intercrystalline corrosion by means of a specific aluminium alloy composition, even after sensitisation as a result of heat. To this end, it proposes the following aluminium alloy composition:

3.1%<Mg<4.5%,
0.4%<Mn<0.85%,
0.4%<Zn<0.8%,
0.06%<Cu<0.35%,
Cr<0.25%,
Fe<0.35%,
Si<0.2%,

Zr<0.25%,
Ti<0.3%, impurities of ≤0.05% in each case and a total of a maximum of 0.15%, balance aluminium.

However, it has been found that the results with respect to the susceptibility to intercrystalline corrosion, which is measured and evaluated in accordance with the Standard ASTM G67, are capable of improvement. Furthermore, the aluminium alloy permits a content of up to 0.25% of zirconium, which is considered to be critical with respect to the recycling of the aluminium alloy. From the international Patent Application WO 99/42627, there is further known a zirconium-containing aluminium alloy which, although it achieved very good results in the ASTM G67 test, is problematic to use owing to the zirconium content which is necessarily present.

SUMMARY OF THE INVENTION

Based on this, an object of the present invention is to provide an aluminium alloy which has only a slight tendency towards intercrystalline corrosion, that is to say, in the ASTM G67 test, provides a mass loss value <15 mg/cm$^2$, high levels of strength and good deformability at the same time and contains standard alloy components so that the recycling of the aluminium alloy is simplified. Furthermore, a use of the aluminium allow and a method for the production of products from the aluminium alloy are intended to be proposed.

According to a first teaching of the present invention, the problem set out above for an aluminium alloy is solved in that it comprises alloy components, which have the following composition in % by weight.

2.91%≤Mg≤4.5%,
0.5%≤Mn≤0.8%,
0.05%≤Cu≤0.30%,
0.05%≤Cr≤0.30%,
0.05%≤Zn≤0.9%,
Fe≤0.40%,
Si≤0.25%,
Ti≤0.20%, the balance Al and impurities individually less than 0.05% and in total a maximum of 0.15% and wherein the following applies to the alloy components Zn, Cr, Cu and Mn:

(2.3* % Zn+1.25* % Cr+0.65* % Cu+0.05* % Mn)+2.4≥% Mg.

"% Zn", "% Cr", "% Cu", "% Mn" and "% Mg" correspond to the contents of the alloy components in percentage by weight in each case. The composition according to the invention is based on the recognition that the alloy components Zn, Cr, Cu and Mn at magnesium contents of at least 2.91% by weight suppresses the precipitation of $\beta$-$Al_5Mg_3$ particles by the presence of these alloy elements supporting the formation of $\tau$ phases. These $\tau$ phases of the type AlCuMgZn suppress the $\beta$ phase formation to a considerable extent so that even with relatively high Mg contents, only a very small tendency to formation of $\beta$ phases or $\beta$-$Al_5Mg_3$ particles exists at the grain boundaries. Furthermore, in the presence of the alloy elements Cr and Mn, $\varepsilon$ phases of the AlCrMgMn type may form and also suppress the $\beta$ phase formation. Consequently, the corresponding aluminium alloy is not so susceptible to intercrystalline corrosion. In addition, it has been found that the compensation efficiency of the individual alloy components Zn, Cr, Cu and Mn is of different levels. The alloy component zinc may, for example, serve to compensate for the 2.3-fold magnesium quantity of 2.91% by weight, so that the resulting aluminium alloy only has a very small tendency towards intercrystalline corrosion.

The efficiency for suppressing the intercrystalline corrosion or the precipitation of β phases decreases with the alloy components chromium, copper and manganese. Consequently, it is possible to provide in any case aluminium alloys which have relatively high magnesium contents and in this regard have higher levels of strength, without tending towards intercrystalline corrosion after the action of temperature. Higher levels of strength with comparable corrosion resistance is achieved with an Mg content of at least 3.0% by weight.

In order to be able to produce the aluminium alloy according to the invention in an economical manner and furthermore not to have to accept any negative effects with respect to the deformability and any or only small changes of the physical properties of the aluminium alloy, for example, when casting and rolling, according to a first embodiment of the aluminium alloy according to the invention it is advantageous for the following to apply to the alloy components Zn, Cr, Cu and Mn:

(2.3* % Zn+1.25* % Cr+0.65* % Cu+0.05* % Mn)+1.4≤% Mg.

There is thereby set out for one embodiment of the present invention an upper limit of the addition of the alloy components Zn, Cr, Cu and Mn in order to achieve the most economical production possible of the aluminium alloy. Additions above this upper limit show no additional positive effect on the resistance with respect to intercrystalline corrosion. In addition, undesirable side effects owing to high contents of the alloy components in this embodiment of the aluminium alloy according to the invention can also be excluded.

According to another embodiment of the aluminium alloy according to the invention, the alloy component Cu preferably has the following content in % by weight:

0.05%≤Cu≤0.20%, in order to configure the aluminium alloy to be generally more corrosion resistant.

According to a next embodiment of the aluminium alloy according to the invention, the deformability can be maximised by the alloy component Cr having the following content in % by weight:

0.05%≤Cr≤0.20%.

According to another embodiment of the aluminium alloy according to the invention, an aluminium alloy which is further optimised with regard to the addition of alloy components and which is resistant to intercrystalline corrosion is produced by the alloy components Mg and Zn having the following contents in % by weight:

2.91%≤Mg≤3.6%, 0.05%≤Zn≤0.75%.

The reduction of the upper limit of the magnesium portion enables further reduction of the maximum zinc concentration, so that a cost-optimised aluminium alloy with very high resistance with respect to intercrystalline corrosion can be provided. Preferably, the Mg content of this embodiment is from 3.0% by weight to 3.6% by weight, in particular from 3.4% by weight to 3.6% by weight.

In another embodiment, the aluminium alloy according to the invention can be further optimised with respect to the strength thereof by the content of the alloy component Mg being at least 3.6% by weight and a maximum of 4.5% by weight. The increased magnesium contents bring about a substantial increase of the strengths of the aluminium alloy with good deformability at the same time. Owing to the specific composition of the aluminium alloy according to the invention, this aluminium alloy, in spite of the high Mg contents, also has only small mass losses <15 mg/cm$^2$ and is consequently in accordance with ASTM G67 free from intercrystalline corrosion. The Mg content is preferably limited to a maximum of 4.0% by weight in order to improve the corrosion behaviour.

As already set out above, the aluminium alloys according to the invention are distinguished in that, in addition to a good level of strength and deformability, they also have very good resistance with respect to intercrystalline corrosion. In this regard, the above-mentioned object is achieved according to another teaching of the invention by the use of an aluminium alloy strip or sheet of an aluminium alloy according to the invention for producing chassis and structural components in vehicle, aircraft or ship construction.

Chassis and structural components of vehicles, motor vehicles or aircraft are often subjected to sources of heat, for example, the exhaust gases of the internal combustion engine or other heat sources, so that aluminium alloys which tend towards intercrystalline corrosion after thermal processing cannot generally be used in this instance. However, the use of an aluminium alloy strip or sheet according to the invention for producing chassis and structural components also enables, owing to the very good resistance with respect to intercrystalline corrosion, the use of stronger aluminium/magnesium alloys with magnesium contents of at least 2.91% by weight in these application fields. The high strength aluminium strips or sheets enable the reduction of wall thicknesses owing to the increased levels of strength. In this regard, they contribute to the further reduction of weight of vehicles, ships or even aircraft.

Preferably, an aluminium alloy strip or sheet comprising the aluminium alloy according to the invention is used for producing a chassis and structural component which is arranged in the region of the engine, the exhaust gas system or other heat sources of a motor vehicle. A typical example of this is a resilient or transverse link of a motor vehicle. Regions of these components, in particular when they are arranged close to the engine, are permanently subjected to an increased introduction of heat. Particularly in motor vehicle construction, but also in the construction of trains, aircrafts and ships, owing to the use of strips and sheets of the aluminium alloy according to the invention new application fields which are characterised by increased introduction of heat are opened up.

The use of an aluminium alloy strip or sheet comprising the aluminium alloy according to the invention is particularly advantageous when the chassis or structural components have at least one weld seam. Weld seams are generally regions in which an introduction of heat into the metal is carried out. This introduction of heat can lead to intercrystalline corrosion if the aluminium alloy has a tendency towards this. However, with aluminium alloys according to the invention, the β phase precipitation which is responsible for the intercrystalline corrosion can be suppressed to the greatest possible extent so that the component can be readily welded and it nonetheless does not have a tendency towards intercrystalline corrosion.

Finally, the use of an aluminium alloy strip or sheet of the aluminium alloy according to the invention is particularly advantageous when the wall thickness of the aluminium alloy strip or sheet is from 0.5 mm to 8 mm, optionally from 1.5 to 5 mm. These wall thicknesses are very suitable for being able to provide the strength required for a chassis or structural component.

According to another teaching of the present invention, an economical production method for an aluminium alloy strip or sheet which comprises the aluminium alloy according to the invention is now intended to be set out. This method comprises the following steps:

casting a rolling ingot, homogenising the rolling ingot at from 500 to 550° C. for at least 2 hours, hot-rolling the rolling ingot to form a thermal strip at hot rolling temperatures of from 280° C. to 500° C., cold-rolling the hot strip with or without intermediate annealing to a final thickness, and soft-annealing the cold strip at from 300° C. to 400° C. in a batch furnace.

In contrast to the previous experiences, with the aluminium alloy according to the invention no specific thermal processing step was required, for example, a solution annealing step at the end of the production process, but instead the aluminium alloy can be produced in a highly economical manner using conventional equipment, for example, batch furnaces. It is also conceivable, in place of casting a rolling ingot, to make provision for direct casting of the strip, which is then subsequently hot and/or cold-rolled.

DETAILED DESCRIPTION OF THE INVENTION

The invention is now intended to be explained in greater detail with reference to embodiments.

TABLE 1

| Alloy components | Alloy | | | | | | |
|---|---|---|---|---|---|---|---|
| | ST5049 conv. | ST5454 conv. | ST5918 conv. | V1 acc. to invention | V2 acc. to invention | V3 acc. to invention | V4 acc. to invention |
| Mg | 2.05 | 2.90 | 3.45 | 2.91 | 3.42 | 3.75 | 3.77 |
| Mn | 0.95 | 0.80 | 0.55 | 0.56 | 0.6 | 0.66 | 0.66 |
| Si | 0.15 | 0.15 | 0.15 | 0.13 | 0.12 | 0.12 | 0.12 |
| Fe | 0.4 | 0.30 | 0.30 | 0.24 | 0.24 | 0.24 | 0.25 |
| Cu | 0.06 | 0.03 | 0.02 | 0.15 | 0.2 | 0.25 | 0.13 |
| Cr | 0.01 | 0.07 | 0.16 | 0.065 | 0.11 | 0.16 | 0.16 |
| Ti | 0.01 | 0.01 | 0.01 | 0.013 | 0.014 | 0.014 | 0.016 |
| Zn | 0 | 0.00 | 0.00 | 0.4 | 0.5 | 0.6 | 0.61 |
| minimum compensation | | 2.9 | 3.45 | 2.91 | 3.42 | 3.75 | 3.77 |
| Mg compensation | | 2.547 | 2.6405 | 3.5155 | 3.8475 | 4.1755 | 4.1205 |

Table 1 first shows the chemical analyses of the standard alloys ST 5049, ST 5454 and ST 5918 and the aluminium alloys V1, V2, V3 and V4 according to the invention. In addition, Table 1 sets out the value for the quantity of magnesium compensated for by the alloy components, which quantity is referred to as "Mg compensation" and was calculated by the following formula:

$$(2.3*\%Zn+1.25*\%Cr+0.65*\%Cu+0.05*\%Mn)+2.4.$$

As a minimum compensation, the value of the "compensated" Mg content is set out and has to be compensated for at least by the alloy components Zn, Cr, Cu and Mn. The value set out in Table 1 therefore corresponds to the Mg content of the respective aluminium alloys.

Since the Mg compensation value is relevant only for aluminium alloys with magnesium contents of at least 2.91% by weight, this value for the standard alloy ST 5049 is not entered. The remaining standard alloys ST 5454 and ST 5918 have an Mg compensation value which is below the magnesium content of the alloy. As known, these alloys have a tendency towards intercrystalline corrosion under specific conditions. The reason is seen in that the Mg content of these aluminium alloys is not sufficiently compensated for. The behaviour is different with the aluminium alloys V1, V2, V3 and V4 according to the invention whose Mg compensation value is substantially above the Mg content of the respective aluminium alloy in % by weight.

TABLE 2

| Alloy | | Measurement variable | | | |
|---|---|---|---|---|---|
| | | $R_{p0.2}$ MPa | $R_m$ MPa | $A_g$ % | $A_{50\,mm}$ % |
| ST5049 | conv. | 99 | 215 | 16.4 | 21.9 |
| ST5454 | conv. | 118 | 246 | 17.4 | 21.8 |
| ST5918 | conv. | 129 | 264 | 18.1 | 19.8 |
| V1 | according to the invention | 115 | 246 | 16.2 | 20.7 |
| V2 | according to the invention | 125 | 271 | 18.5 | 21.3 |
| V3 | according to the invention | 132 | 288 | 15.8 | 20.6 |
| V4 | according to the invention | 133 | 289 | 18.7 | 22.0 |

From all seven aluminium alloys, rolling ingots were cast and the rolling ingots were homogenised at temperatures of from 500 to 550° C. for at least two hours. The rolling ingots produced in this manner were hot-rolled to form a hot strip at hot-rolling temperatures of from 280° C. to 500° C. and subsequently cold-rolled to the final thickness, wherein an intermediate annealing operation took place and the subsequent soft-annealing of the cold strip at temperatures of between 300 and 400° C. took place in a batch furnace. The strip thickness was 1.5 mm.

From the strips produced, sheets were removed and their characteristic mechanical values in the tensile test according to DIN EN 10002-1 perpendicular relative to the rolling direction were established. The measurement values are set out in Table 2. They show that the embodiment V1 according to the invention, for example, has a substantially higher tensile strength and yield strength than the standard alloy ST5049. The elongation values $A_g$ for the uniform elongation and $A_{50mm}$ of the alloy strips according to the invention and the standard alloys do not differ significantly so that it can be assumed that the aluminium alloys according to the invention have identical deformability to the standard alloys.

The alloy variant V2, in comparison with the standard alloy ST 5454 also provides a higher tensile strength and a higher yield strength. For the uniform elongation $A_g$ and elongation $A_{50mm}$ there are also produced for the variant V2 according to the invention almost identical values to the standard alloy ST 5454. The same also applies to the variants V3 and V4 which, in comparison with the conventional aluminium alloy variant ST 5918, have improved tensile strength values and yield strengths. Consequently, the aluminium alloys according to the invention have very good characteristic mechanical values and can be processed in an identical manner to the comparable standard alloys.

The embodiments according to the invention and the conventional embodiments were now subjected to a corrosion test according to ASTM G67 by means of which, by measuring the mass loss, the susceptibility of an aluminium alloy with respect to intercrystalline corrosion can be measured. In this test, test strips which are 50 mm long and 60 mm wide are cut from the sheet or strip and, with or without prior thermal treatment, are stored in concentrate nitric acid at 30° C. for 24 hours. Nitric acid preferably releases β phases from the grain boundaries and thereby brings about, during the subsequent weight measurement, a substantial loss of mass if precipitated β phases are present in the sample along the grain boundaries.

In order also to establish the susceptibility with respect to intercrystalline corrosion in thermally loaded application fields, the samples, prior to a mass loss measurement in accordance with ASTM G67, were also subjected to a pre-treatment in the form of storage at high temperatures. To this end, the samples were stored for 17, 100 and 500 hours at 130° C. and subsequently subjected to the mass loss test. Furthermore, however, a storage for 100 hours at 100° C. was also carried out in order to achieve the comparability of the aluminium alloys according to the invention with those of the aluminium alloys known from the prior art.

TABLE 3

| | Alloy | | | | | | |
|---|---|---|---|---|---|---|---|
| Storage | ST5049 | ST5454 | ST5918 | V1 | V2 | V3 | V4 |
| Without | 1.1 | 1.1 | 1.3 | 1.3 | 1.6 | 2.0 | 1.8 |
| 17 h 130° C. | 1.0 | 1.4 | 2.3 | 1.4 | 1.8 | 2.4 | 1.9 |
| 100 h 130° C. | 1.0 | 5.6 | 11.3 | 1.5 | 2.4 | 3.5 | 2.9 |
| 500 h 130° C. | 1.1 | 16.2 | 30.9 | 1.9 | 6.7 | 8.3 | 8.9 |
| 100 h 100° C. | 1.0 | 2.1 | 5.2 | 1.4 | 2.1 | 2.6 | 2.1 |

In Table 3, the respective test conditions of the storage and the measured mass loss are set out after a test in accordance with ASTM G67 in mg/cm$^2$. According to ASTM G67, aluminium alloys which are resistant with respect to intercrystalline corrosion reach from 1 to 15 mg/cm$^2$ of mass loss, whereas those which are non-resistant have a mass loss of from 25 to 75 mg/cm$^2$.

It can clearly be seen that the standard alloy ST 5049 which has a relatively low magnesium content of 2.05% by weight, has the highest resistance with respect to intercrystalline corrosion. Even with occurrences of storage of 500 hours at 130° C., this aluminium alloy does not change its corrosion behaviour in the test. However, it also has the lowest mechanical strength values.

In contrast, the standard alloy ST 5454 and the standard alloy ST 5918 behave differently. ST 5454 has at 500 hours of pre-sensitisation at 130° C. a mass loss of 16.2 mg/cm$^2$. The mass loss of ST 5918, when the samples are stored for 100 hours or for 500 hours at 130° C., also exhibits a very substantial increase of the mass loss after storage in concentrate nitric acid to a maximum of 30.9 mg/cm$^2$. If the aluminium alloys according to the invention are compared with this after being stored for 500 hours at 130° C., they are substantially more stable with respect to intercrystalline corrosion in spite of similarly high magnesium contents.

The maximum mass loss of the aluminium alloy V4 according to the invention was at 500 hours at 130° C. 8.9 mg/cm$^2$ and consequently lower than the standard alloy ST 5918 by more than a factor of three. According to ASTM G67 it is deemed to be stable with respect to intercrystalline corrosion since its mass loss is lower than 15 mg/cm$^2$. In spite of higher magnesium contents compared with the respective standard alloys ST 5454 or ST 5918, and higher strength values, the aluminium alloy according to the invention is distinguished by outstanding resistance with respect to intercrystalline corrosion.

In particular, comparisons with the results known from the prior art for aluminium alloys with a high content of magnesium show that, in the selected aluminium alloy field, a substantial increase of the resistance of the aluminium alloys with respect to intercrystalline corrosion can be achieved, without having to accept problems with respect to recycling or high production costs.

Finally, it could also be shown that highly economical batch furnaces can also be used to carry out soft-annealing operations in order to provide aluminium alloys and alloy products which have a high magnesium content and which are resistant with respect to intercrystalline corrosion. Previously, it was assumed that a solution annealing operation in a continuous process line was required in order to achieve resistance with respect to intercrystalline corrosion.

The invention claimed is:

1. Aluminium alloy consisting of alloy components, which have the following composition in % by weight:

2.91%≤Mg≤4.5%,
0.5%≤Mn≤0.8%,
0.05%≤Cu≤0.30%,
0.05%≤Cr≤0.30%,
0.05%≤Zn≤0.9%,
Fe<0.40%,
Si<0.25%,
Ti<0.20%, the balance Al and impurities individually less than 0.05% and in total a maximum of 0.15% and wherein the following applies to the alloy components Zn, Cr, Cu and Mn:

(2.3* %Zn+1.25* %Cr+0.65* %Cu+0.05* %Mn) +2.4≥%Mg and (2.3* %Zn+1.25* %Cr+0.65* %Cu+0.05* %Mn) +1.4≤%Mg.

2. Aluminium alloy according to claim 1, wherein the alloy component Cu has the following content in % by weight:

0.05%≤Cu≤0.20%.

3. Aluminium alloy according to claim 1, wherein the alloy component Cr has the following content in % by weight:

0.05%≤Cr≤0.20%.

4. Aluminium alloy according to claim 1, wherein the alloy components Mg and Zn have the following contents in % by weight:

2.91%≤Mg≤3.6%,
0.05%≤Zn≤0.75%.

5. Aluminium alloy according to claim 1, wherein the content of the alloy component Mg is at least 3.6% by weight and a maximum of 4.5% by weight.

6. Aluminium alloy according to claim 1, wherein the aluminium alloy experiences an intercrystalline corrosion mass loss of less than 15mg/cm$^2$ as measured according to ASTM G67.

7. Aluminium alloy according to claim 1, wherein the aluminium alloy experiences an intercrystalline corrosion mass loss of less than 15 mg/cm$^2$ as measured according to ASTM G67 after being exposed to a temperature of 130° C. for at least 500 hours.

8. A method of using an aluminium alloy strip or sheet of an aluminium alloy according to claim 1, comprising a step of producing at least one of chassis and structural components in vehicle, aircraft or ship construction using said aluminium alloy.

9. The method according to claim 8, wherein the aluminium alloy strip or sheet is used for producing a chassis or structural component which is arranged in the region of the engine, the exhaust gas system or other heat sources of a motor vehicle.

10. The method according to claim 8, wherein the chassis or structural components have at least one weld seam.

11. The method according to claim 8, wherein the wall thickness of the aluminium alloy strip or sheet is from 0.5 mm to 8 mm, optionally from 1.5 to 5 mm.

12. Method for producing an aluminium alloy strip or sheet from an aluminium alloy according to claim 1 comprising the following steps:

casting a rolling ingot, homogenising the rolling ingot at from 500 to 550 ° C. for at least 2 hours, hot-rolling the rolling ingot to form a thermal strip at hot rolling temperatures of from 280° C. to 500 ° C., cold-rolling the hot strip with or without intermediate annealing to a final thickness, and soft-annealing the cold strip at from 300 ° C. to 400 ° C. in a batch furnace.

* * * * *